US007325405B1

(12) United States Patent
Henderson et al.

(10) Patent No.: US 7,325,405 B1
(45) Date of Patent: Feb. 5, 2008

(54) UTENSIL COOLING DEVICE

(76) Inventors: Anthony C. Henderson, 727 E. 104th Pl., Chicago, IL (US) 60628; Steven B. Moore, 7257 S. Hoyne Ave., Chicago, IL (US) 60636

( * ) Notice: Subject to any disclaimer, the term of this patent is extended or adjusted under 35 U.S.C. 154(b) by 426 days.

(21) Appl. No.: 10/911,430

(22) Filed: Aug. 5, 2004

(51) Int. Cl.
*F21B 21/02* (2006.01)

(52) U.S. Cl. ..... 62/3.2

(58) Field of Classification Search ..... 62/3.2, 62/3.7, 371, 457.9, 186, 259.2; 165/80.3, 165/104.33; 454/186, 236
See application file for complete search history.

(56) References Cited

U.S. PATENT DOCUMENTS

| | | | | |
|---|---|---|---|---|
| 2,825,208 | A | 3/1958 | Anderson | |
| 5,431,022 | A | 7/1995 | Abe | |
| 5,524,440 | A | 6/1996 | Nishioka et al. | |
| 5,603,220 | A | 2/1997 | Seaman | |
| 5,704,223 | A | 1/1998 | MacPherson et al. | |
| 5,865,032 | A | 2/1999 | MacPherson et al. | |
| 6,463,743 | B1 * | 10/2002 | Laliberte | 62/3.3 |
| 6,484,626 | B1 * | 11/2002 | Tsai et al. | 99/495 |
| 6,510,696 | B2 * | 1/2003 | Guttman et al. | 62/3.3 |
| 6,580,025 | B2 * | 6/2003 | Guy | 136/201 |
| 6,598,405 | B2 * | 7/2003 | Bell | 62/3.3 |
| D480,273 | S | 10/2003 | Cordwell | |
| 6,705,089 | B2 * | 3/2004 | Chu et al. | 62/3.2 |
| 6,722,139 | B2 * | 4/2004 | Moon et al. | 62/3.2 |
| 6,747,869 | B2 * | 6/2004 | Dong | 361/687 |

FOREIGN PATENT DOCUMENTS

| | | | |
|---|---|---|---|
| JP | 9-98318 A | * | 4/1997 |

* cited by examiner

*Primary Examiner*—Mohammad M. Ali

(57) ABSTRACT

An electric clipper cooling device includes a body that has a cavity, spaced inner and outer layers, an external power source, a combination fan and vent, and a thermoelectric cooler disposed therein. A heat absorbing material is disposed between said inner and outer layers and lies adjacent the cavity for assisting to draw heated air outwardly therefrom. A plurality of elongated tubes are connected to the cooler and the cavity respectively for allowing the exchange of air therebetween. Air that has a first temperature is drawn to the cooler via one of the tubes and air that has a second temperature is introduced to the cavity via another of the tubes so that an electric device disposed within the body can be cooled during non-operating conditions.

12 Claims, 5 Drawing Sheets

UTENSIL COOLING DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a cooling device and, more particularly, to a utensil cooling device for electric hairstyling clippers and like devices.

2. Prior Art

The use of electric hair clippers is well known in the industry. Professional hair salons, local barbers, pet groomers and individuals at home all use these devices. A common problem that occurs with devices such as electrical hair clippers is heat generated by the movable blades, due to friction, and heat generated from the electrical current used to power such devices.

This heat can inconveniently be transferred to the hands of the person using the device, resulting in sweating, that can lead to the individual dropping the device. Damage is thus inflicted to the device which is costly to repair and costly to replace. Another problem is when the heat generated in the cutting blades is transferred to the individual whose hair is being cut. Such transferred heat can cause inconvenient burns and general discomfort during the hair cut, which could lead to the individual not returning to that particular hair dresser in the future.

When the hair cutting device overheats, time must be taken to wait for that device to cool down again before another hair cut can be administered with it. This will result in lost revenue for the hair dresser, or cause the hair dresser to inconveniently have to purchase more than one of the same hair cutting devices.

Accordingly, a need remains for a utensil cooling device that would be safe to use, result in time savings, result in cost savings and increase customer comfort. The present invention satisfies such a need by increasing the effective use of electric clippers for not only professional hair dressers, but also for pet groomers and consumers.

BRIEF SUMMARY OF THE INVENTION

In view of the foregoing background, it is therefore an object of the present invention to provide a utensil cooling device. These and other objects, features, and advantages of the invention are provided by a utensil cooling device for electric hairstyling clippers and like devices employed by hair stylists and barbers.

The device includes a body that has top and bottom portions defining a cavity therebetween for vertically receiving electric hairstyling clippers therein. The top portion has a substantially planar top surface and is provided with an aperture formed medially therein. The body preferably further includes a lower surface spaced upwardly from the bottom portion for supporting a cooling device (described hereinbelow) subjacent the cavity.

The body includes spaced inner and outer layers defining a gap therebetween and extending about a perimeter of the device. The device may further include a flexible heat-absorbing layer disposed within the gap for conveniently drawing heat away from the cavity and may include a copper wire mesh coated along an inner surface of the cavity for effectively conducting heat away from the electric hairstyling scissors disposed therein. A power cord is provided for coupling the body to an external power source.

The present invention further includes a combination fan and vent electrically coupled to the power source and disposed within the body. Such a combined unit advantageously evacuates heated air through the vent. A thermoelectric cooler is electrically coupled to the power source, and is disposed within the body. Such a cooler may include conventional cooling devices, well known to a person of ordinary skill in the art.

The present invention also includes a plurality of elongated tubes having opposed end portions connected to the cooler and the cavity respectively. Air that has a first temperature is drawn to the cooler via one of the plurality of tubes and air that has a second temperature is introduced to the cavity via another the plurality of tubes wherein the first air temperature is preferably higher than the second air temperature.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
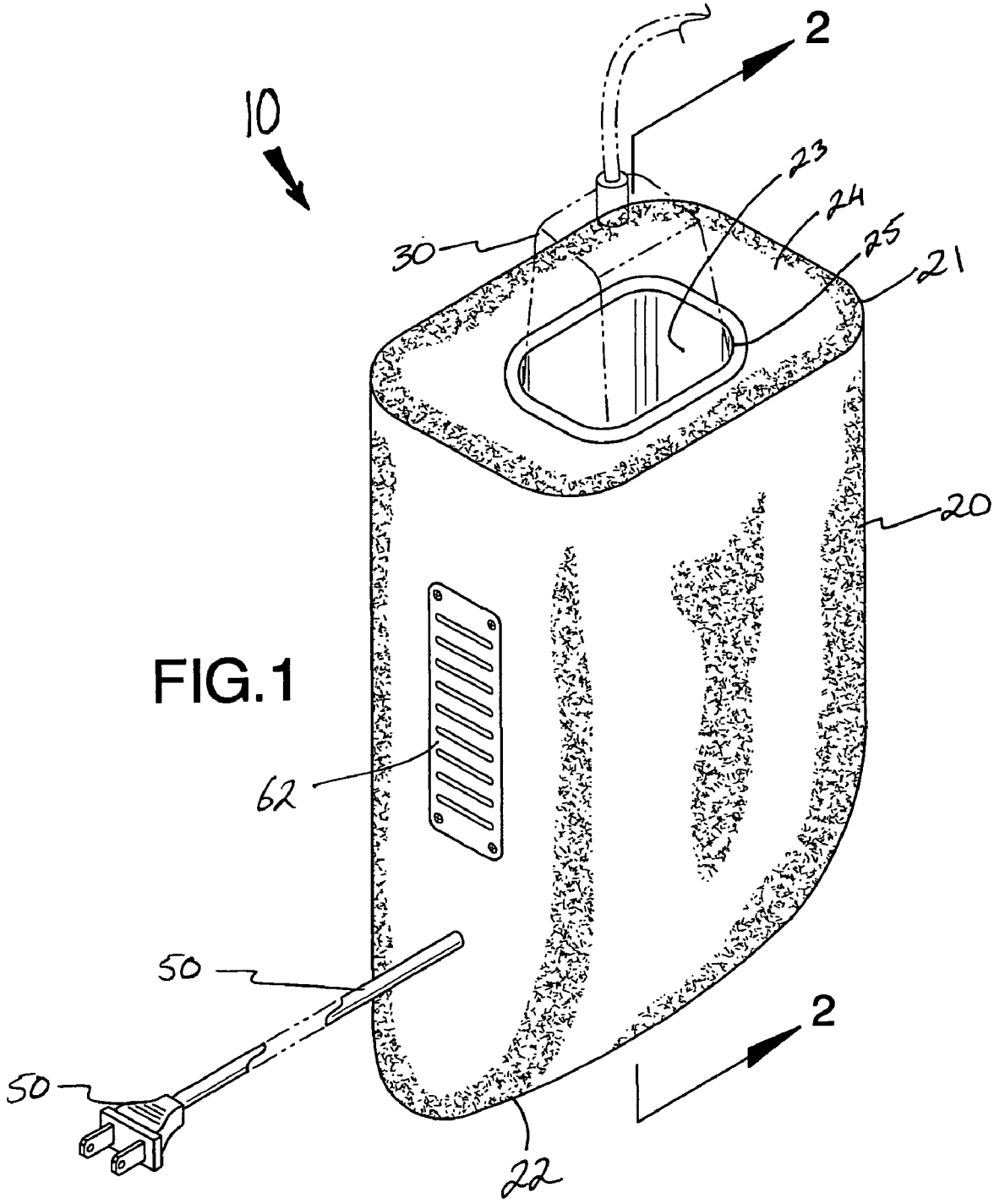
FIG. 1 is a perspective view showing a utensil cooling device for electric hairstyling clippers and like devices, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–5 by the reference numeral 10 and is intended to provide a utensil cooling device. It should be understood that the device 10 may be used to cool many different types of heat-generating utensils and should not be limited to only electrical hairstyling clippers.

Referring initially to FIG. 1, the device 10 includes a body 20 that has top 21 and bottom 22 portions defining a cavity 23 therebetween for vertically receiving electric hairstyling clippers 30 therein. The top portion 21 has a substantially planar top surface 24 and is provided with an aperture 25 formed medially therein. The body 20 further includes a lower surface 26 spaced upwardly from the bottom portion 22 for supporting a cooling device 70 (described hereinbelow) subjacent the cavity 23.

Figure 2:
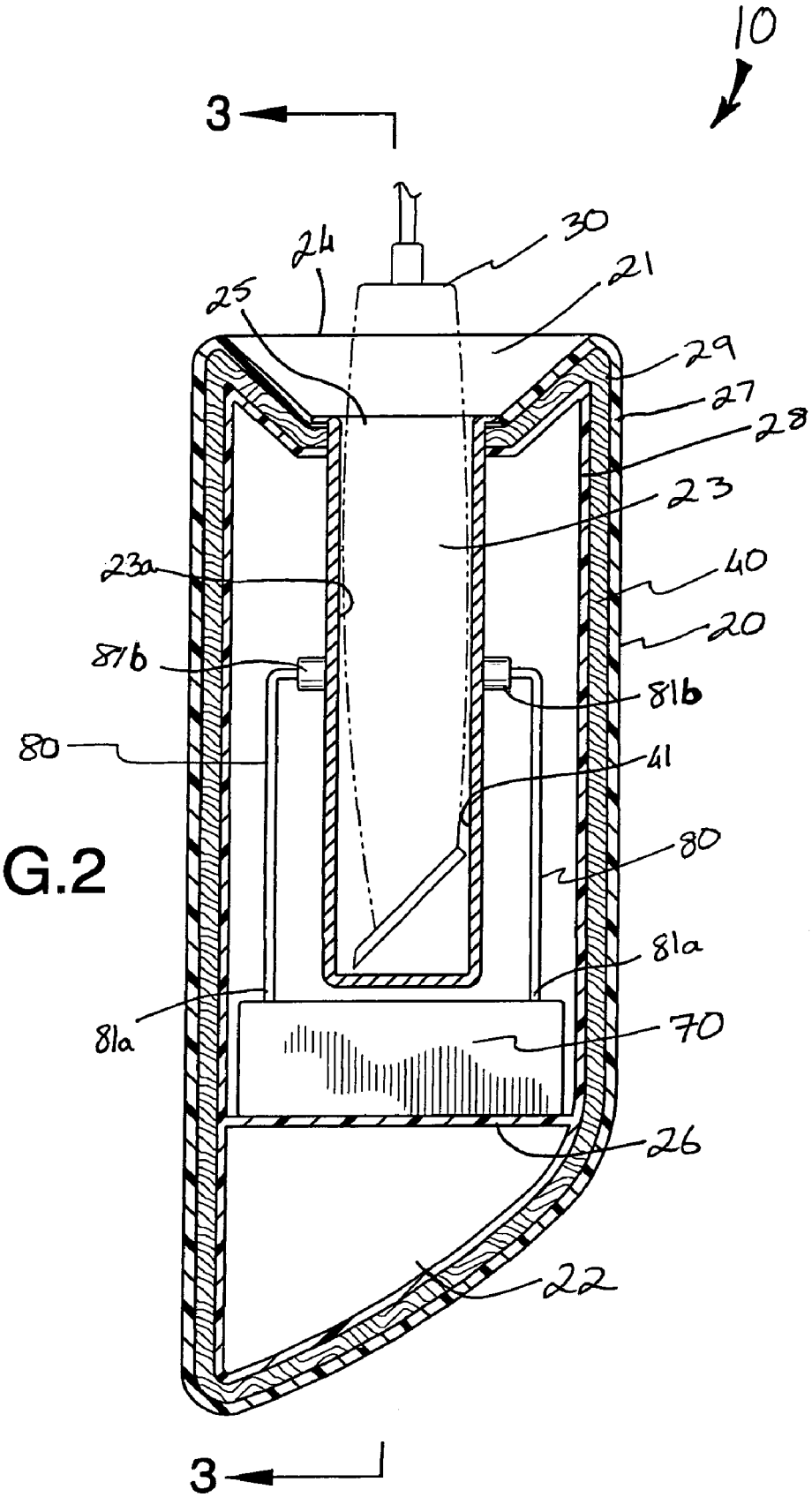
FIG. 2 is a cross-sectional view of the device shown in FIG. 1, taken along line 2—2.
Figure 3:
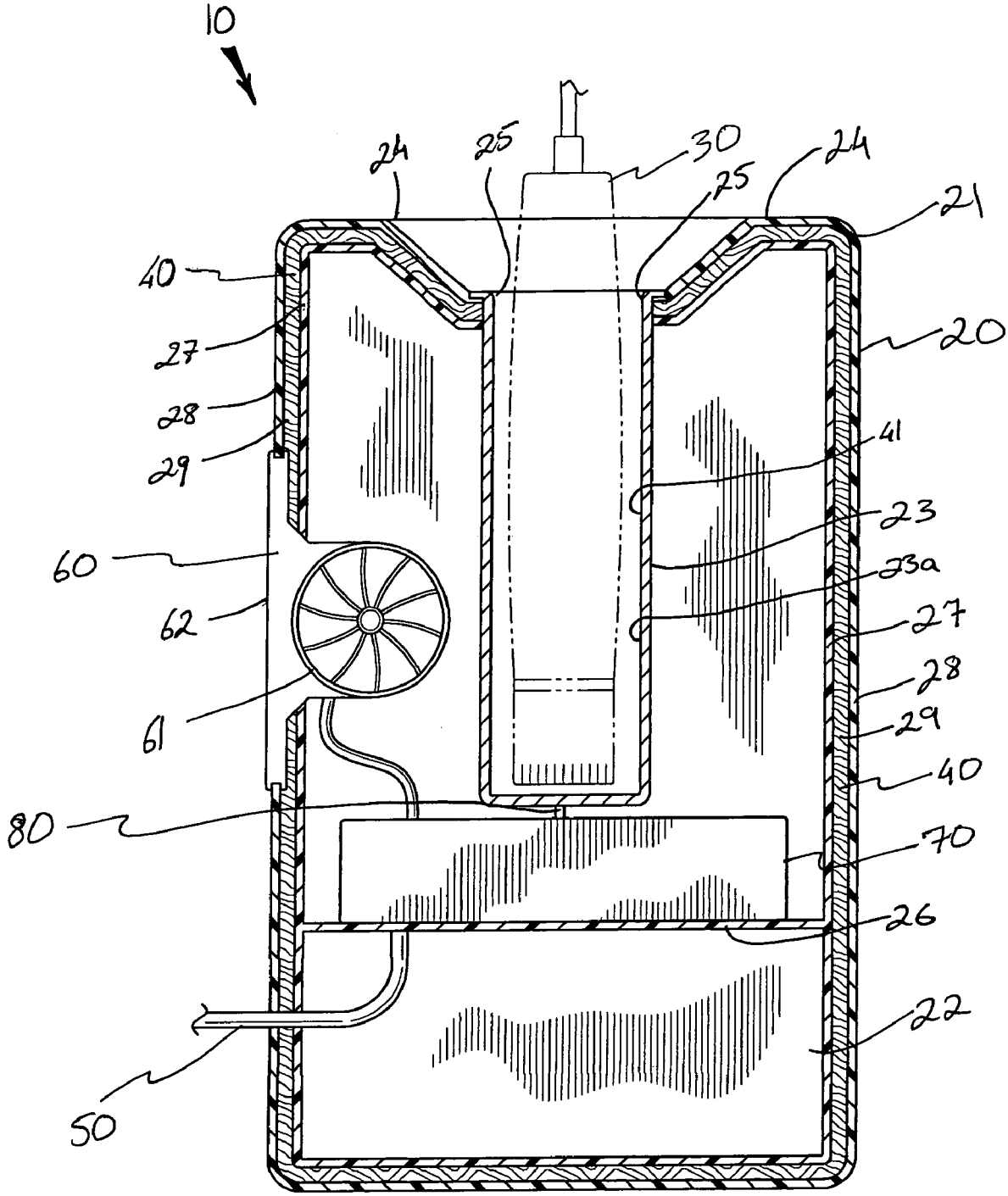
FIG. 3 is a cross-sectional view of the device shown in FIG. 1, taken along line 3—3.
Figure 4:
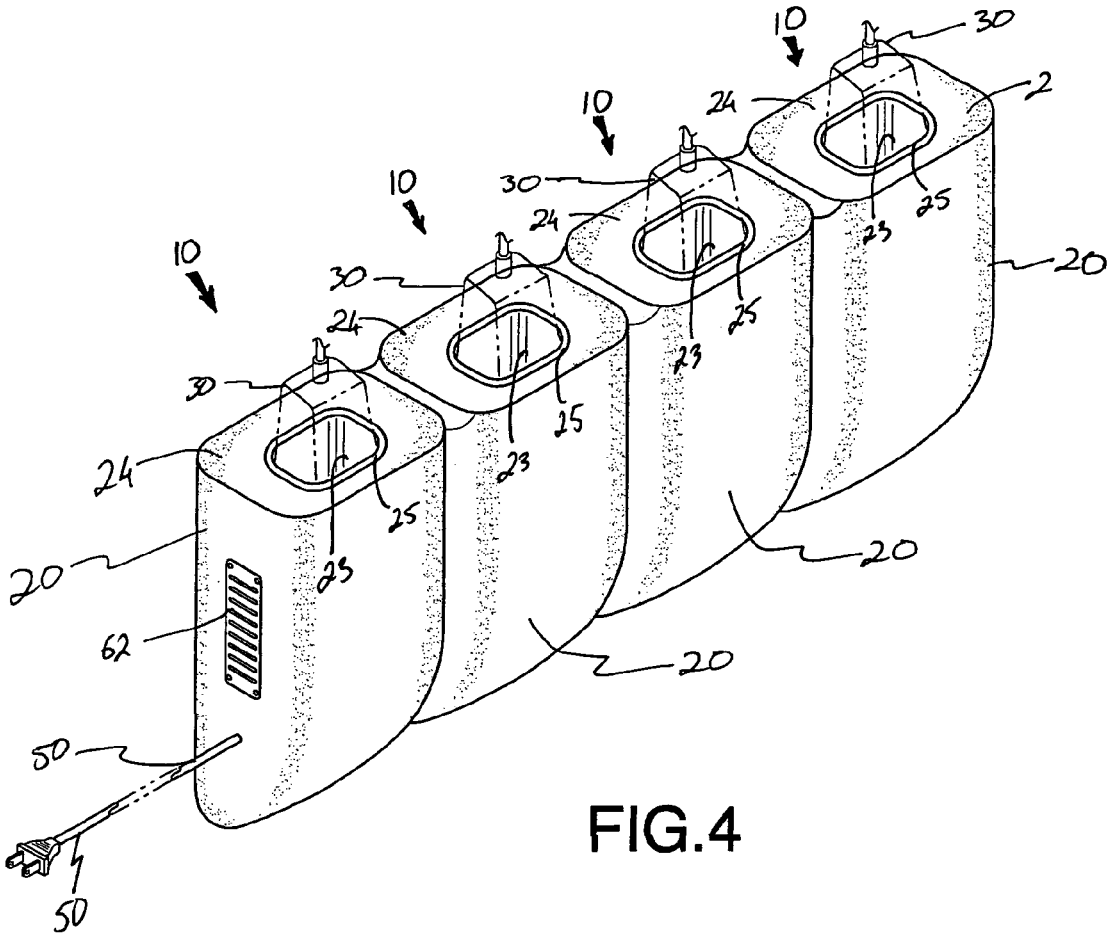
FIG. 4 is a perspective view showing a plurality of utensil cooling devices juxtaposed along a linear plane.
Figure 5:
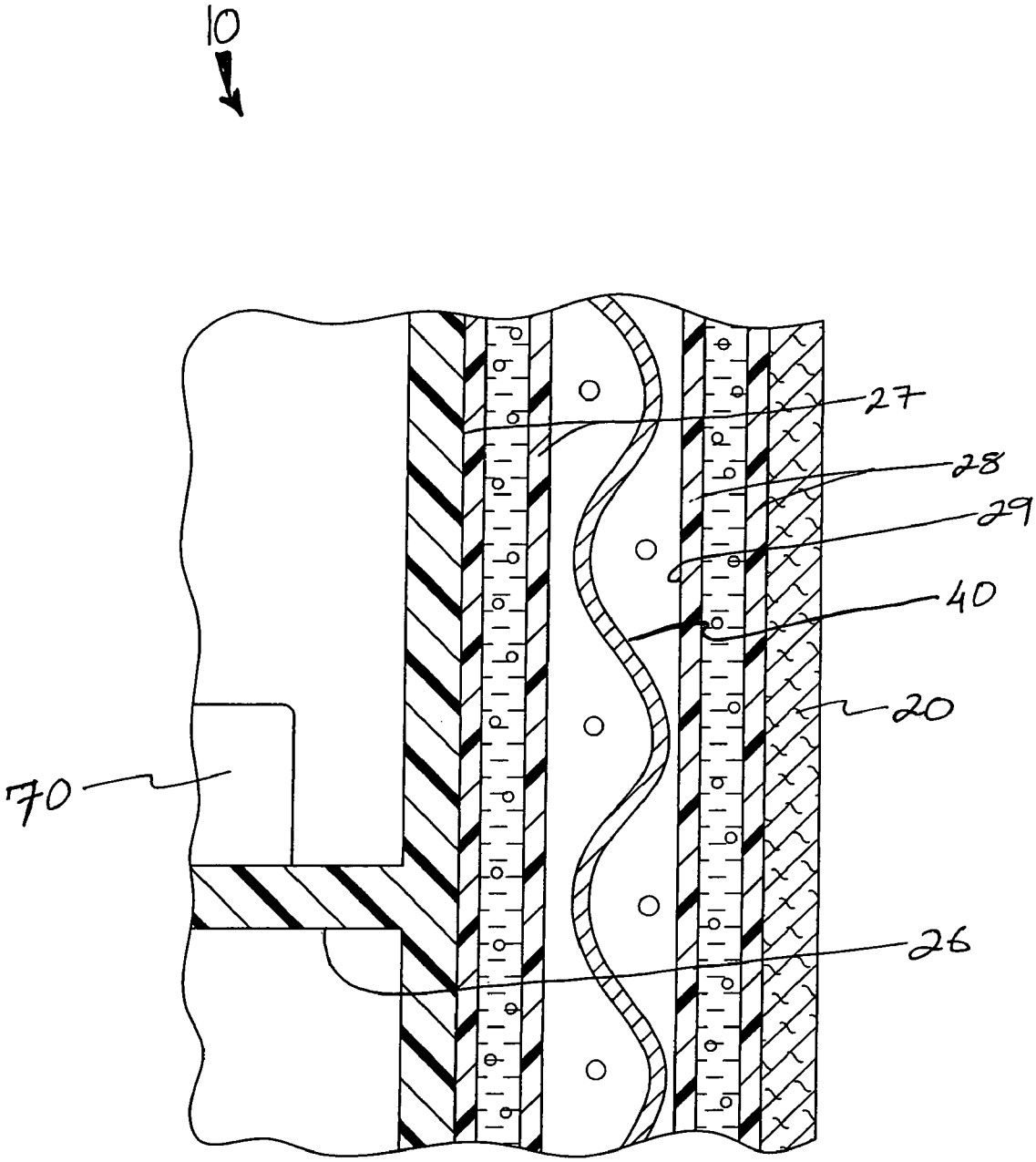
FIG. 5 is a partially enlarged cross-sectional view of the device shown in FIG. 3

Referring to FIGS. 2, 3 and 5, the body 20 also includes spaced inner 27 and outer layers 28 defining a gap 29 therebetween and extending about a perimeter of the device 10. The device 10 further includes a flexible heat-absorbing layer 40 disposed within the gap 29 for conveniently drawing heat away from the cavity 23 and includes a copper wire mesh 41 coated along an inner surface 23*a* of the cavity 23 for effectively conducting heat away from the electric hairstyling scissors 30 disposed therein. This feature advantageously prevents the user of the hairstyling scissors 30 from getting sweaty hands, which could lead to dropping and breaking the scissors 30. A power cord 50 is provided for coupling the body 20 to an external power source.

As is shown in FIG. 3, the present invention further includes a combination fan 61 and vent 62 electrically coupled to the power source and disposed within the body 20. Such a combined unit 60 advantageously evacuates heated air through the vent 62. Cooling of the hairstyling scissors 30 advantageously reduces the daily wear and tear that is usually caused by overheating, thus increasing the amount of time such scissors 30 can be effectively used. This saves the hairstylist money that would usually be spent on replacing worn out scissors 30. A thermoelectric cooler 70 is electrically coupled to the power source, and is disposed within the body 20. Such a cooler 70 may include conventional cooling devices, well known to a person of ordinary skill in the art.

As illustrated in FIG. 2, the present invention also includes a plurality of elongated tubes 80 having opposed end portions 81*a, b* connected to the cooler 70 and the cavity 23 respectively. Air that has a first temperature is drawn to the cooler 70 via one of the plurality of tubes 80 and air that has a second temperature is introduced to the cavity 23 via another the plurality of tubes 80 wherein the first air temperature is preferably higher than the second air temperature. Cooling the hairstyling scissors 30 by these means allows a hairdresser to grasp them for longer periods of time, which saves a considerable amount of time and effort while styling hair. This allows for more haircuts to be performed in a shorter period of time, thus improving productivity and customer satisfaction.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A utensil cooling device for electric hairstyling clippers and like devices employed by hair stylists and barbers, said device comprising:

a body having top and bottom portions defining a cavity therebetween for vertically receiving electric hairstyling clippers therein, said top portion having a substantially planar top surface and being provided with an aperture formed medially therein, said body comprising spaced inner and outer layers defining a gap therebetween and extending about a perimeter of said device;

an external power source;

a combination fan and vent electrically coupled to said power source and disposed within said body, said fan for evacuating heated air through said vent;

a thermoelectric cooler electrically coupled to said power source and being disposed within said body; and a plurality of elongated tubes having opposed end portions connected to said cooler and said cavity respectively wherein air having a first temperature is drawn to said cooler via one said plurality of tubes and air having a second temperature is introduced to the cavity via another said plurality of tubes.

2. The device of claim 1, further comprising: a flexible heat-absorbing layer disposed within the gap and for drawing heat away from the cavity.

3. The device of claim 1, wherein the first air temperature is higher than the second air temperature.

4. The device of claim 1, wherein said body further comprises: a lower surface spaced upwardly from said bottom portion and for supporting said cooler subjacent the cavity.

5. The device of claim 1, further comprising: a copper wire mesh coated along an inner surface of the cavity for conducting heat away the electric hairstyling scissors disposed therein.

6. A utensil cooling device for electric hairstyling clippers and like devices employed by hair stylists and barbers, said device comprising:

a body having top and bottom portions defining a cavity therebetween for vertically receiving electric hairstyling clippers therein, said top portion having a substantially planar top surface and being provided with an aperture formed medially therein, said body comprising spaced inner and outer layers defining a gap therebetween and extending about a perimeter of said device, said body further comprising a lower surface spaced upwardly from said bottom portion and for supporting said cooler subjacent the cavity;

an external power source;

a combination fan and vent electrically coupled to said power source and disposed within said body, said fan for evacuating heated air through said vent;

a thermoelectric cooler electrically coupled to said power source and being disposed within said body; and a plurality of elongated tubes having opposed end portions connected to said cooler and said cavity respectively wherein air having a first temperature is drawn to said cooler via one said plurality of tubes and air having a second temperature is introduced to the cavity via another said plurality of tubes.

7. The device of claim 6, further comprising: a flexible heat-absorbing layer disposed within the gap and for drawing heat away from the cavity.

8. The device of claim 6, wherein the first air temperature is higher than the second air temperature.

9. The device of claim 6, further comprising: a copper wire mesh coated along an inner surface of the cavity for conducting heat away the electric hairstyling scissors disposed therein.

10. A utensil cooling device for electric hairstyling clippers and like devices employed by hair stylists and barbers, said device comprising:

a body having top and bottom portions defining a cavity therebetween for vertically receiving electric hairstyling clippers therein, said top portion having a substantially planar top surface and being provided with an aperture formed medially therein, said body comprising spaced inner and outer layers defining a gap therebetween and extending about a perimeter of said device, said device further comprising a flexible heat-absorbing layer disposed within the gap and for drawing heat away from the cavity, said body further comprising a lower surface spaced upwardly from said bottom portion and for supporting said cooler subjacent the cavity;

an external power source;

a combination fan and vent electrically coupled to said power source and disposed within said body, said fan for evacuating heated air through said vent;

a thermoelectric cooler electrically coupled to said power source and being disposed within said body; and a plurality of elongated tubes having opposed end portions connected to said cooler and said cavity respectively wherein air having a first temperature is drawn to said cooler via one said plurality of tubes and air having a second temperature is introduced to the cavity via another said plurality of tubes.

11. The device of claim 10, wherein the first air temperature is higher than the second air temperature.

12. The device of claim 10, further comprising: a copper wire mesh coated along an inner surface of the cavity for conducting heat away the electric hairstyling scissors disposed therein.

* * * * *